United States Patent [19]

Morduchowitz et al.

[11] Patent Number: 4,732,655

[45] Date of Patent: Mar. 22, 1988

[54] MEANS AND METHOD FOR PROVIDING TWO CHEMICAL PRODUCTS FROM ELECTROLYTES

[75] Inventors: Abraham Morduchowitz, Monsey, N.Y.; Ronald L. Cook, Aurora, Ill.

[73] Assignee: Texaco Inc., White Plains, N.Y.

[21] Appl. No.: 873,024

[22] Filed: Jun. 11, 1986

[51] Int. Cl.[4] ..... C25C 1/00

[52] U.S. Cl. ..... 204/59 R

[58] Field of Search ..... 204/59 R, 265, 258, 204/270, 261

[56] References Cited

U.S. PATENT DOCUMENTS

| | | | |
|---|---|---|---|
| 1,376,207 | 4/1921 | Jacobs | 204/265 |
| 3,262,868 | 7/1966 | Juda | 204/265 |
| 4,173,524 | 11/1979 | McRae | 204/265 |
| 4,271,003 | 6/1981 | Lindstrom | 204/265 |

OTHER PUBLICATIONS

Websters 7th Collegiate Dictionary, p. 837.

*Primary Examiner*—R. L. Andrews

*Attorney, Agent, or Firm*—Robert A. Kulason; James J. O'Loughlin; Ronald G. Gillespie

[57] ABSTRACT

A method and apparatus for providing two chemical products includes a reaction cell having an anode chamber and a cathode chamber. The anode chamber is separated from the cathode chamber by an ionic transfer membrane. Each chamber has an electrode connected to a source of DC voltage. A first electrolyte with a first sparging gas is provided to the anode chamber, while a second electrolyte with a second sparging gas is provided to the cathode chamber. The DC voltage, in cooperation with the electrolytes and the sparging gases causes products to form, one in each chamber. The first product is removed from the reacted electrolyte that emerges from the anode chamber while the second product is removed from the reacted electrolyte emerging from the cathode chamber.

2 Claims, 1 Drawing Figure

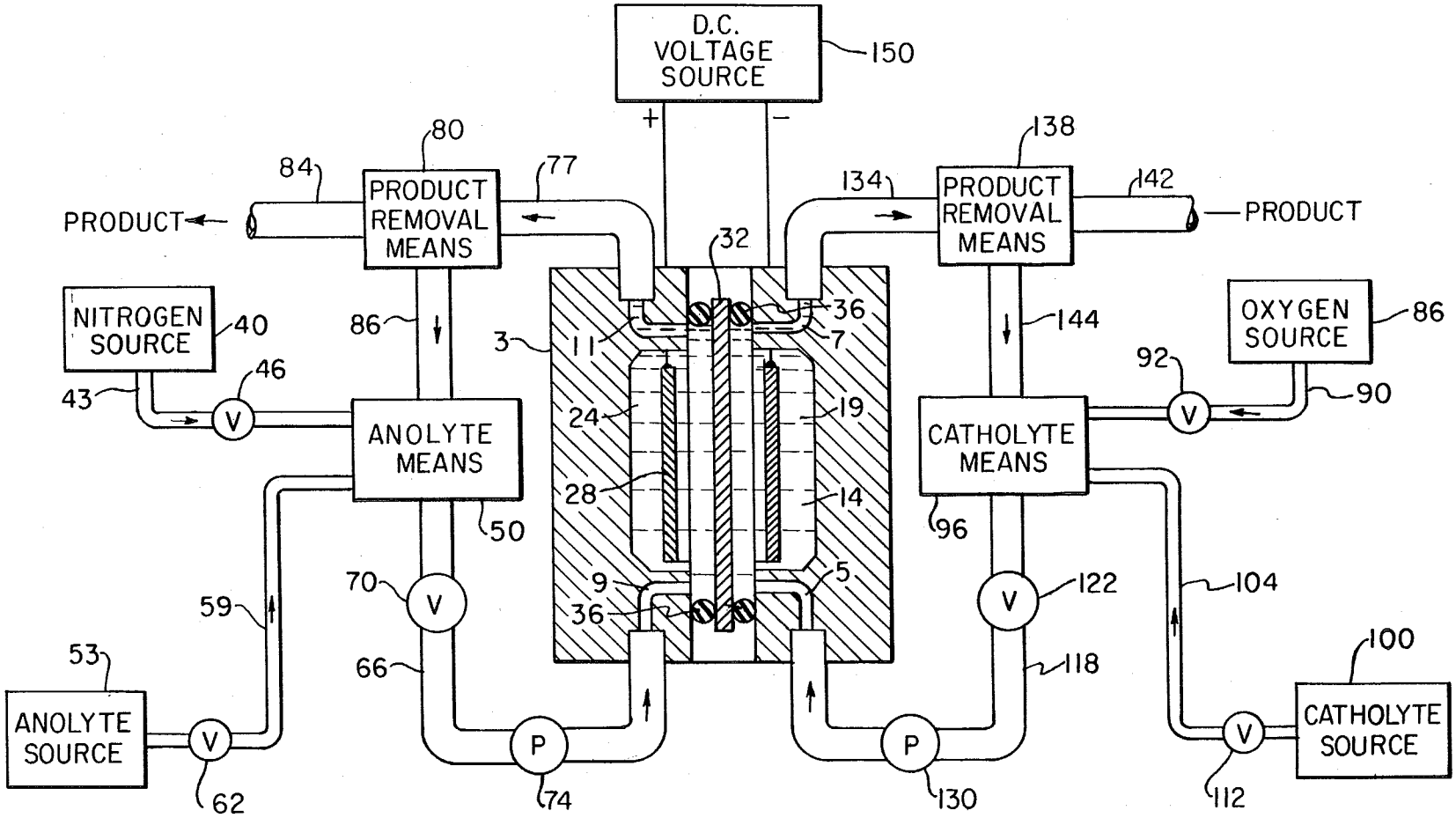
D.C. VOLTAGE SOURCE
150
PRODUCT REMOVAL MEANS
138
PRODUCT
142
134
144
OXYGEN SOURCE
86
90
92
CATHOLYTE MEANS
96
CATHOLYTE SOURCE
100
104
112
122
118
130
P
36
7
19
14
5
32
11
24
28
9
36
3
77
PRODUCT REMOVAL MEANS
80
84
PRODUCT
86
ANOLYTE MEANS
50
70
66
74
NITROGEN SOURCE
40
46
43
59
62
ANOLYTE SOURCE
53

MEANS AND METHOD FOR PROVIDING TWO CHEMICAL PRODUCTS FROM ELECTROLYTES

BACKGROUND OF THE INVENTION

Field of the Invention

The present invention relates to electrochemical processes in general.

SUMMARY OF THE INVENTION

A method and apparatus for providing two chemical products includes a reaction cell having an anode chamber and a cathode chamber. The anode chamber is separated from the cathode chamber by an ionic transfer membrane. Each chamber has an electrode connected to a source of DC voltage. A first electrolyte with a first sparging gas is provided to the anode chamber, while a second electrolyte with a second sparging gas is provided to the cathode chamber. The DC voltage, in cooperation with the electrolytes and the sparging gases caused products to form, one in each chamber. The first product is removed from the reacted electrolyte that emerges from the anode chamber while the second product is removed from the reacted electrolyte emerging from the cathode chamber.

The objects and advantages of the invention will appear more fully hereinafter, from a consideration of the detailed description which follows, taken together with the accompanying drawing, wherein one embodiment is illustrated by way of example. It is to be expressly understood, however, that the drawing is for illustrative purposes only, and is not to be construed as defining the limits of the invention.

DESCRIPTION OF THE DRAWING

The FIGURE shows a simplified block diagram and reaction cell of an apparatus, constructed in accordance with the present invention for forming two products from electrolytes having sparging gases.

DESCRIPTION OF THE INVENTION

With reference to the drawing, a reaction cell 3 has passageways 5, 7, 9 and 11. Passageways 5, 7, 9 and 11 provide the entrances and exits for electrolytic solutions as hereinafter explained. Reaction cell 3 has a cathode chamber 14 in which a cathode 19, made of platinum, is maintained. Reaction cell 3 also has an anode chamber 24 in which an anode 28, made of platinum, is maintained.

Cathode chamber 14 is separated from anode chamber 24 by an ionic transfer, membrane 32, which may be a Nafion separator. Spacers 36, which also acts as seals, keep separator 32 in proper relationship to cathode chamber 14 and anode chamber 24.

A nitrogen source 40 provides nitrogen by way of a line 43 having a control valve 46 to anolyte means 50. An anolyte source 53 provides an electrolyte, which may be methanol with 0.1M of tetrabutylammonium perchlorate, to anolyte means 50 by way of a line 59 having a control valve 62. Anolyte means 50 provides the anolyte with nitrogen to passageway 9 of reaction cell 3 by way of a line 66 having a control valve 70 and a pump 74. The anolyte with nitrogen enters anode chamber 24 and exits anode chamber 24 by way of passageway 11 and line 77 to product removal means 80. Product removal means 80 might be in the form of a separation column. One such separation column is a distillation column. The product is provided by product separation means 80 by way of a line 84 and the remaining anolyte with nitrogen is provided back to electrolyte means 50 by way of feed line 86.

A source 86 of oxygen provides oxygen by way of a line 90 having a control valve 92 to catholyte means 96. A catholyte source 100 provides a catholyte, which may be a mixture of methanol, benzene and tetrabutylammonium perchlorate via a feed line 104 having a control valve 112, to catholyte means 96. Catholyte means 96 provides the catholyte with oxygen to passageway 5 of reaction cell 3 by way of a line 118 having a control valve 122 and a pump 130. The catholyte with oxygen from passageway 5 enters anode chamber 14 and exits reaction cell 3 by way of passageway 7 and a line 134. The reacted catholyte in line 134 is provided to product removal means 138. Product removal means 138, which may be of a similar type as product removal means 80, provides a product by way of a line 142. The catholyte without the product is returned to catholyte means 96 by way of feed line 144.

A D.C. voltage sourve 150 has its "+" terminal electrically connected to anode 28 and its "−" terminal connected to cathode 19. The D.C. voltage provided by source 150 cooperates with the sparging gas and the electrodes in the reaction of the electrolytes.

In the reaction, the oxygen and nitrogen are used as sparging gases in cathode chamber 14 and in anode chamber 24, respectively. The reaction in cathode chamber 14 yields phenol as a product which is removed by product removal means 82 as previously explained. The reaction in the anode chamber 24 forms a product of dimethoxymethane which is removed by product removal means 82, as previously explained.

In one example of the present invention 0.1M of benzene was added to a methanol solution containing 0.1M tetrabutylammonium perchlorate. The passage of one electron/mole through the solution of a current density of 3 mA/cm$^2$ yielded phenol at approximately 40 to 60 percent current efficiency. A smaller amount of a second product, benzene related was also formed with increase in yield and the number of electrons/mole were passed through the solution.

What is claimed is:

1. A method comprising the steps of:

locating an anode in an anode chamber of a reaction cell, locating a cathode in a cathode chamber of the reaction cell, separating the cathode chamber from the anode chamber by an ionic transfer membrane, providing nitrogen as a sparging gas to the anode chamber of the reaction cell, providing a mixture of tetrabutylammonium perchlorate and methanol as an anolyte to the anode chamber, providing oxygen as a sparging gas to the cathode chamber of the reaction cell, providing a mixture of methanol, benzene and tetrabutylammonium perchlorate as a catholyte to the cathode chamber of the reaction cell, applying a DC voltage across the anode and the cathode thereby forming dimethoxymethane in the anolyte and phenol in the catholyte, removing dimethoxymethane from the reacted anolyte, and removing phenol from the reacted catholyte.

2. A method comprising the steps of:

providing an anode and a cathode, flowing a mixture of tetrabutylammonium perchlorate and methanol as an anolyte around the anode, flowing a mixture of methanol, benzene and tetrabutylammonium perchlorate as a catholyte around the cathode, providing nitrogen and oxygen sparging gases to the flowing anolyte and the flowing catholyte, respectively, separating the flowing anolyte from the flowing catholyte with an ionic transfer membrane, providing a DC voltage across the anode and cathode to cause a reaction so that the reacted anolyte contains dimethoxymethane and the reacted catholyte contains phenol, and removing the dimethoxymethane, and the phenol from the anolyte and the catholyte, respectively.

* * * * *